US007517174B2

(12) United States Patent
Wolynski et al.

(10) Patent No.: US 7,517,174 B2
(45) Date of Patent: Apr. 14, 2009

(54) MOLDED PILE

(75) Inventors: Victor Wolynski, Cocoa, FL (US); Dale E. Polk, Jr., Titusville, FL (US); Dean Higley, Titusville, FL (US)

(73) Assignee: LRM Industries, LLC, Rockledge, FL (US)

( * ) Notice: Subject to any disclaimer, the term of this patent is extended or adjusted under 35 U.S.C. 154(b) by 0 days.

(21) Appl. No.: 12/102,042

(22) Filed: Apr. 14, 2008

(65) Prior Publication Data

US 2008/0273928 A1 Nov. 6, 2008

Related U.S. Application Data

(60) Provisional application No. 60/927,401, filed on May 3, 2007.

(51) Int. Cl.
*E02D 15/00* (2006.01)

(52) U.S. Cl. ..... 405/249; 405/232; 52/731.2

(58) Field of Classification Search ..... 405/232, 405/248, 249; 52/592.1, 731.3, 721.4
See application file for complete search history.

(56) References Cited

U.S. PATENT DOCUMENTS

| | | | |
|---|---|---|---|
| 844,294 | A | 2/1907 | Winslow |
| 1,804,706 | A | 5/1931 | Radice |
| 2,229,912 | A | 1/1941 | Baily |
| 2,797,466 | A | 7/1957 | Lidberg |
| 3,200,599 | A | 8/1965 | Phares et al. |
| 3,354,657 | A | 11/1967 | Turzillo |
| 3,512,365 | A | 5/1970 | Muller |
| 3,636,718 | A | 1/1972 | Keats |
| 3,664,139 | A | 5/1972 | Sexauer |
| 3,842,608 | A | 10/1974 | Turzillo |
| 3,972,198 | A | 8/1976 | Maly et al. |
| 5,213,889 | A | 5/1993 | Cogswell et al. |
| 5,494,378 | A | 2/1996 | Hanson |
| 5,534,318 | A | 7/1996 | Andre De La Porte et al. |
| 5,704,732 | A | 1/1998 | Horton, III |
| 5,951,207 | A | 9/1999 | Chen |
| 6,129,487 | A | 10/2000 | Bermingham et al. |
| 6,142,712 | A | 11/2000 | White et al. |
| 6,231,270 | B1 | 5/2001 | Cacossa |
| 6,732,483 | B1 | 5/2004 | White |

*Primary Examiner*—Tara L. Mayo
(74) *Attorney, Agent, or Firm*—James R. Franks

(57) ABSTRACT

The present invention relates to a molded pile (e.g., 17) that includes a unitary elongated body (52) and an elongated tube (142) residing longitudinally within the elongated body (52). The elongated body (52) includes first (151) and second (154) exterior elongated plates that are spaced apart and opposed to each other. The elongated body (52) also includes a plurality of internal ribs (157) interposed between and being continuous with the first (151) and second (154) exterior elongated plates. The internal ribs (157) together define a plurality of apertures (67) and an elongated passage (160) that extends the length of the elongated body (52). The elongated tube (142) resides within the elongated passage (160), and provides fluid communication between upper (145) and lower (148) ends of the elongated body. Passage of a high pressure fluid (e.g., water and/or air) through elongated tube 142 results in fluidization of a penetrable material (e.g., soil) into which the lower portion (58) of the elongated body (52) is driven. The apertures (67) are dimensioned to receive fluidized penetrable material therein, thereby anchoring the lower portion (58) of the elongated body (52) within the penetrable material (178). The present invention also relates to a method of installing or anchoring the molded pile in a penetrable material (178).

25 Claims, 6 Drawing Sheets

MOLDED PILE

The present nonprovisional patent application is entitled to and claims the right of priority under 35 U.S.C. § 119(e) of U.S. Provisional Patent Application Ser. No. 60/927,401 filed May 3, 2007, which is hereby incorporated herein in its entirety by reference.

FIELD OF THE INVENTION

The present invention relates to a molded pile that includes an elongated body and an elongated tube, residing within an elongated passage of the elongated body, which provides fluid communication between upper and lower ends of the elongated body. The elongated body includes a first exterior elongated plate, a second exterior elongated plate, and a plurality of internal ribs interposed between the first and second exterior plates. The internal ribs define the elongated passage in which the elongated tube resides. The elongated tube is adapted to provide for passage of a fluid at elevated pressure through the elongated hollow interior thereof. Passage of high pressure fluid through the elongated tube fluidizes a penetrable material into which a lower portion of the elongated body is driven, resulting in the formation of fluidized penetrable material. The apertures of the elongated body are dimensioned to receive fluidized penetrable material therein, thereby anchoring the lower portion of the elongated body within the penetrable material. The present invention also relates to a method of installing a molded pile in a penetrable material.

BACKGROUND OF THE INVENTION

Piles are used in a number of applications including, for example, supports for structures, such as decks and marine docks, and anchors to which separate structures are attached, for example by means of cables. Typically, a lower portion of a pile is driven into a displaceable or penetrable material, such as earth, soil or sand. An upper portion of the pile extends outward from the material into which the lower portion has been driven, and is typically attached to a separate structure, such as a deck, or provides an anchoring point.

Typically, piles must be sufficiently robust so as to both withstand insertion into a displaceable material, and provide support for structures that may be subsequently attached thereto. Insertion into the displaceable material (e.g., soil) is often achieved by driving (e.g., pounding) the pile directly into the displaceable material. As such, piles are often fabricated from wood and/or metal, for example, in the form of solid rectangular beams or I-beams. Wood and metal beams, while sufficiently robust, are subject to rot and corrosion in many environments in which they are used. In addition, wood and metal beams can be heavy, resulting in increased fuel costs associated with transporting to and handling thereof at the work site.

Piles may also be formed in-situ. For example, a cylinder is inserted into the ground with the concurrent supply of a high pressure fluid, such as water, and concrete is then pumped into and optionally around the inserted cylinder. See, for example, U.S. Pat. Nos. 3,354,657; 3,636,718; 3,664,139; and 3,842,608.

In addition to being sufficiently robust so as to both withstand insertion into the ground, and provide load bearing support, it is also desirable that the pile be sufficiently retained within the ground. Retention of the pile within the ground may be achieved by pumping concrete around the base and/or the sides of the lower portion of the pile. Alternatively, or in addition thereto, the lower portion of the pile may be fitted with screw-like lateral extensions that serve to hold the pile within the ground.

It would be desirable to develop new pile designs that provide a combination of light weight and high strength. In addition, it would be further desirable that such new pile designs also provide for improved retention of the pile within the material into which it is driven.

U.S. Pat. No. 844,294 discloses an anchor that includes: an end-section having a plurality of barb-shaped enlargements; at least one superposed section that is connected to the end-section; and at least one pipe extending the length of the anchor, for passage of water there-through during sinking of the anchor into the ground. The anchor of the '294 Patent is fabricated from molded plastic.

SUMMARY OF THE INVENTION

In accordance with the present invention, there is provided a molded pile comprising:

(a) an elongated body having an upper end and a lower end, and comprising,
  (i) a first exterior elongated plate,
  (ii) a second exterior elongated plate, said first exterior elongated plate and second exterior elongated plate being spaced apart and being substantially opposed from each other, and
  (iii) a plurality of internal ribs interposed between said first exterior elongated plate and said second exterior elongated plate, said plurality of internal ribs defining at least one elongated passage, and said plurality of internal ribs together defining a plurality of apertures,
  wherein said first exterior elongated plate, said second exterior elongated exterior plate and said plurality of internal ribs are each independently fabricated from a plastic material and are substantially continuous with each other, and said elongated body is a substantially unitary elongated body; and (b) an elongated tube residing within said elongated passage, said elongated tube having an upper opening and a lower opening each being in fluid communication with an elongated hollow interior of said elongated tube, said elongated tube providing fluid communication between said upper end and said lower end of said elongated body, and being adapted to provide for passage of a fluid at elevated pressure through said elongated hollow interior thereof, wherein passage of said fluid at elevated pressure through said elongated hollow interior of said elongated tube fluidizes a penetrable material into which a lower portion of said elongated body of said molded pile is driven, thereby forming a fluidized penetrable material, and said apertures of said lower portion defined by said plurality of internal ribs being dimensioned to receive fluidized penetrable material therein, thereby anchoring said lower portion of said elongated body within said penetrable material.

In further accordance with the present invention, there is also provided a method of installing a pile comprising:

(A) providing a molded pile as described above;

(B) positioning said lower end of said elongated body adjacent to a surface of a penetrable material;

(C) introducing a fluid at elevated pressure into said upper opening of said elongated tube, and allowing said fluid to pass through said elongated hollow interior and exit said lower opening of said elongated tube at elevated pressure; and (D) driving, concurrently with step (C), a lower portion of said elongated body of said molded pile into said penetrable material, wherein said fluid exiting said lower opening of said elongated tube impinges upon said penetrable material, thereby forming fluidized penetrable material, further wherein said apertures of said lower portion of said elongated body of said molded pile are dimensioned to receive fluidized penetrable material therein, thereby anchoring said lower portion of said elongated body within said penetrable material.

The features that characterize the present invention are pointed out with particularity in the claims, which are annexed to and form a part of this disclosure. These and other features of the invention, its operating advantages and the specific objects obtained by its use will be more fully understood from the following detailed description and accompanying drawings in which preferred embodiments of the invention are illustrated and described.

As used herein and in the claims, terms of orientation and position, such as "upper", "lower", "inner", "outer", "right", "left", "vertical", "horizontal", "top", "bottom", and similar terms, are used to describe the invention as oriented in the drawings. Unless otherwise indicated, the use of such terms is not intended to represent a limitation upon the scope of the invention, in that the invention may adopt alternative positions and orientations.

Unless otherwise indicated, all numbers or expressions, such as those expressing structural dimensions, quantities of ingredients, etc., as used in the specification and claims are understood as modified in all instances by the term "about".

BRIEF DESCRIPTION OF THE DRAWINGS

In FIGS. 1 through 6, like reference numerals designate the same components and structural features, unless otherwise indicated.

DETAILED DESCRIPTION OF THE INVENTION

Figure 1:
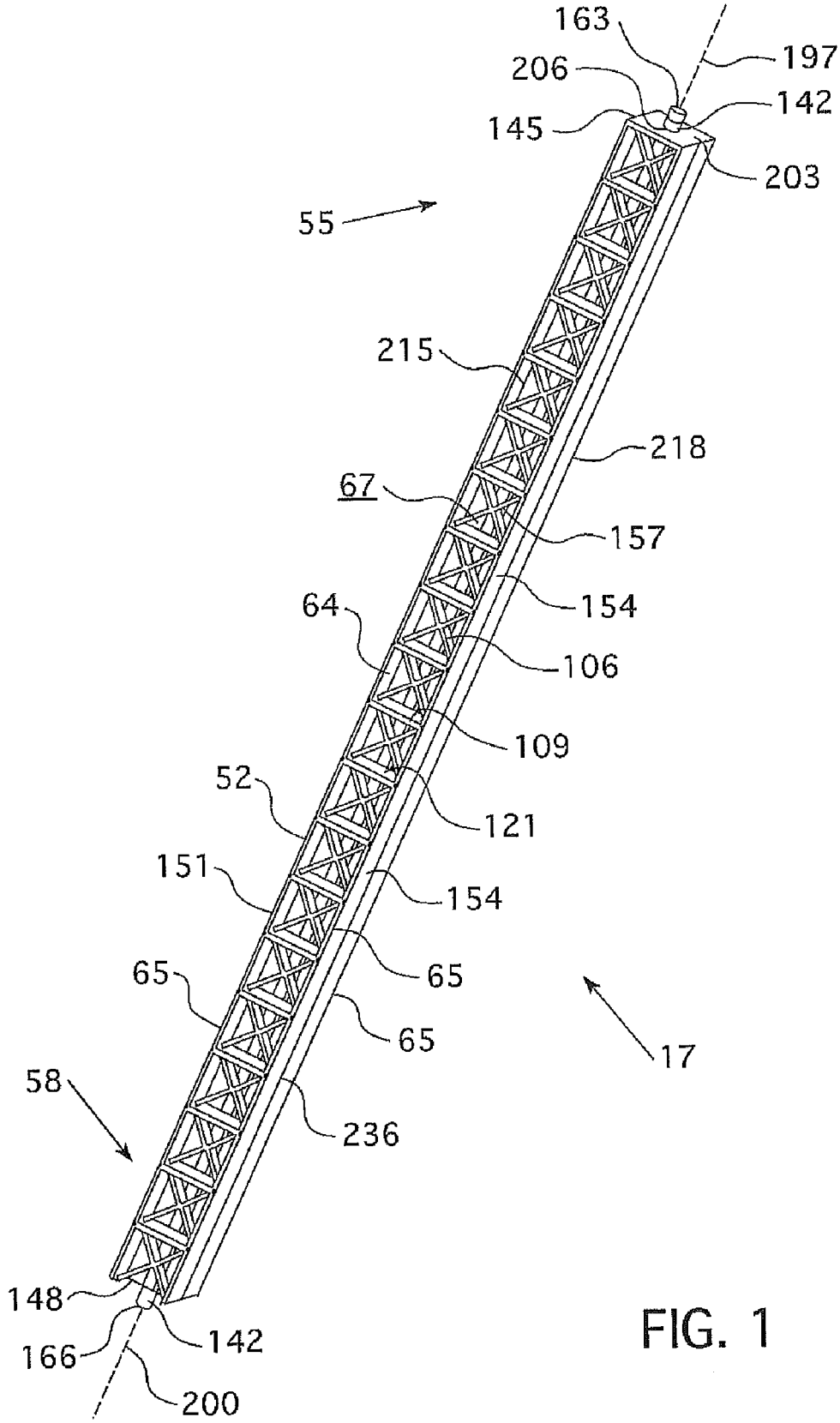
FIG. 1 is a representative perspective view of a molded pile according to the present invention.

With reference to FIG. 1 of the drawings, a molded pile 17, according the present invention, is depicted and includes as major components, an elongated body 52 and an elongated tube 142 that resides within elongated body 52. Elongated body 52 includes an upper end 145 and a lower end 148. Elongated body 52 also has an upper portion 55, a lower portion 58, a first exterior elongated plate 151, and a second exterior elongated plate 154. First exterior elongated plate 151 and second exterior elongated plate 154 are spaced apart and are substantially opposed from each other, and each have two opposed elongated edges 65 (only one elongated edge 65 of each of first exterior elongated plate 151 and second exterior elongated plate 154 being visible in FIG. 1).

As used herein and in the claims, the term "lower portion" with regard to the elongated body of the molded pile means that portion which is or may be retained within a penetrable material (e.g., earth, sand, snow, ice, or a cementations material, such as cement, e.g., Portland cement). Accordingly, the "upper portion" of the pile is that portion which is not (or may not be) retained within a penetrable material. Typically, the length of the lower portion of the elongated body of the molded pile represents from 10 percent to less than 50 percent, more typically from 15 percent to 45 percent, and further typically from 20 percent to 40 percent, based on the total length of the elongated body of the molded pile. The length of the upper portion of the elongated body of the pile typically represents from 50 percent to 90 percent, more typically from 55 percent to 85 percent, and further typically from 60 percent to 80 percent, based on the total length of the elongated body of the pile. Unless otherwise noted, the recited percent length values are inclusive of the recited values.

Elongated body 52 also includes a plurality of internal ribs 157 that are interposed between first exterior elongated plate 151 and second exterior elongated plate 154. Internal ribs 157 define at least one elongated passage 160, and together define a plurality of apertures 67. Elongated passage 160 extends the entire length of elongated body 52 and provides fluid communication between upper end 145 and lower end 148 thereof. The internal ribs 157 of elongated body 52 may have numerous configurations. For example, as depicted in the drawings, internal ribs 157 include angled ribs 106 and cross (or lateral) ribs 109. Lateral ribs 109 also include an upper surface 121, that may serve as a load bearing surface for separate components that may be attached to elongated body 52 (e.g., one or more brackets—not shown).

First exterior elongated plate 151, second exterior elongated plate 154 and the plurality of internal ribs 157 are each independently fabricated from a plastic material, as will be discussed in further detail herein. Typically, first exterior elongated plate 151, second exterior elongated plate 154 and internal ribs 157 are each fabricated from the same plastic material. First exterior elongated plate 151, second exterior elongated plate 154 and internal ribs 157 are substantially continuous with each other, and as such elongated body 52 is a substantially unitary elongated body 52.

The elongated body of the molded pile of the present invention may have numerous cross-sectional shapes. Generally, the elongated body has a substantially rectangular or square cross-sectional shape. The exterior surfaces of the first and second exterior elongated plates may each independently have a profile selected from substantially flat profiles (as depicted in the drawings), convex profiles, concave profiles, and combinations thereof. In addition, the exterior surfaces of the first and second exterior elongated plates may have grooves (e.g., lateral, horizontal, and/or angled grooves), such as vertical groove 236. Providing the exterior surfaces of the first and/or second exterior elongated plates with grooves may enhance insertion of the molded pile into a penetrable material (e.g., soil). The grooves in the exterior surfaces of the first and/or second exterior elongated plates may, for example, provide pathways or channels through which fluidized penetrable material may travel up and away from the lower end of the elongated body as it is driven into a penetrable material.

The molded pile (e.g., 17) of the present invention also includes an elongated tube 142 that resides within elongated passage 160. Elongated tube 142 has an upper opening 163 and a lower opening 166, each of which is in fluid communication with an elongated hollow interior 169 of elongated tube 142. Elongated tube 142 provides fluid communication between upper end 145 and lower end 148 of elongated body 52. In addition, elongated tube 142 is adapted to provide for passage of a fluid (e.g., water and/or air) at elevated pressure (i.e., greater than ambient pressure) through the elongated hollow interior 169 thereof. By selection of the materials of fabrication, and sidewall thicknesses, elongated tube 142 may be adapted so as to provide passage of a high pressure fluid there-through, as is known to the skilled artisan.

Figure 6:
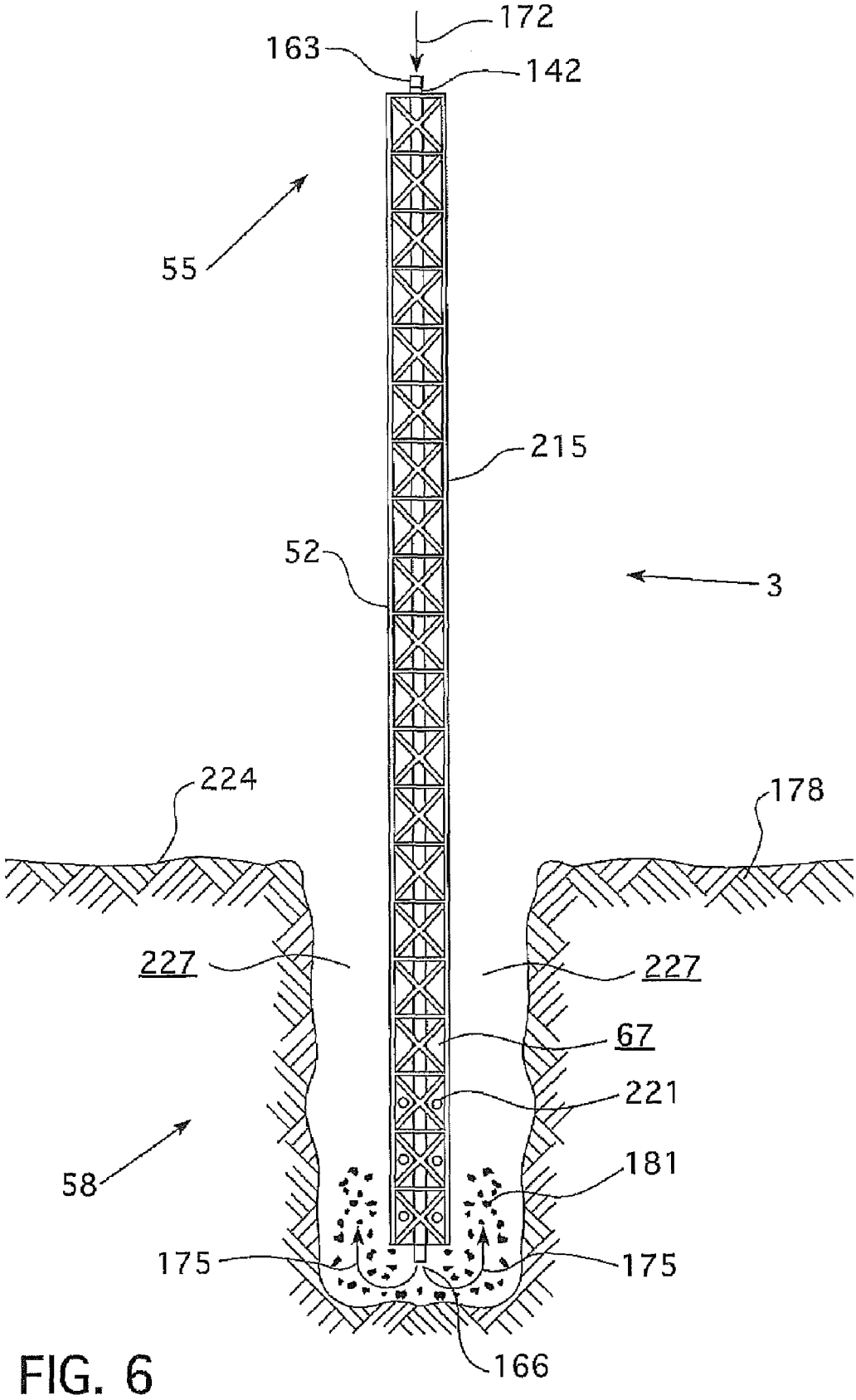
FIG. 6 is a representative partial sectional and side elevational view of the molded pile of FIG. 5 being driven with fluid assistance into a penetrable material.

With reference to FIG. 6, passage of a fluid, such as water and/or air, through elongated tube 142 assists driving of the molded pile (e.g., molded pile 3) of the present invention into a penetrable material 178 (e.g., soil), and anchoring the molded pile therein. More particularly, a fluid at elevated pressure is introduced into upper opening 163 of elongated tube 142 (as represented by arrow 172), passes through the elongated hollow interior 169 thereof and emerges from lower opening 166 of the tube (as represented by arrows 175). The high pressure fluid emerging from lower opening 166 of tube 142 fluidizes the penetrable material 178 (e.g., soil and/or sand) into which lower portion 58 of elongated body 52 is driven. Contact of the high pressure fluid emerging from lower opening 166 of tube 142 fluidizes at least some of the penetrable material 178 it comes into contact with, and thereby forms a fluidized penetrable material 181. The fluidized penetrable material 181 typically comprises particulate penetrable material (e.g., soil particles) suspended in the fluid emerging from lower opening 166 of tube 142. The plurality of apertures 67 of elongated body 52 of the molded pile (e.g., molded pile 3) are dimensioned to receive fluidized penetrable material 181 therein.

Figure 4:
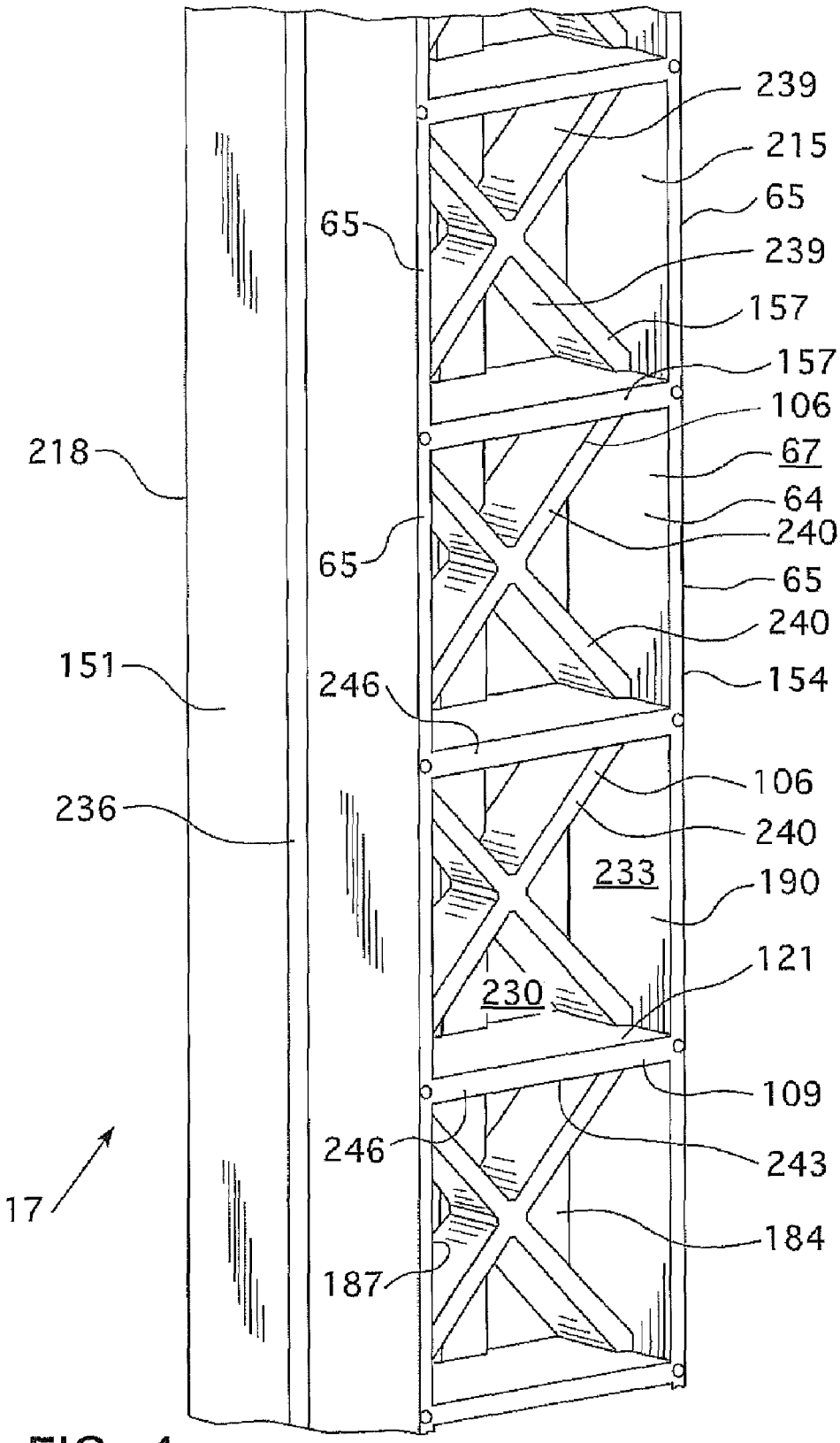
FIG. 4 is a representative enlarged perspective view of a portion of the molded pile of FIG. 1.

The fluidized penetrable material 181 received within apertures 67 of elongated body 52 becomes non-fluidized (in particular, when high pressure fluid is no longer passed through tube 142) and substantially continuous with non-fluidized penetrable material surrounding lower portion 58 of elongated body 52. The receipt of fluidized penetrable material into apertures 67, and the subsequent conversion (or reversion) thereof into non-fluidized penetrable material within apertures 67 that is continuous with non-fluidized material there-around, serves to better anchor lower portion 58 of elongated body 52 of the molded pile within the penetrable material (e.g., 178). More particularly, the fluidized penetrable material (e.g., fluidized penetrable material 181 of FIG. 6) enters apertures 67 and comes to rest in a non-fluidized state on and/or against the sidewalls/surfaces of the internal ribs and elongated exterior plates that define the apertures. With reference to FIG. 4, the non-fluidized penetrable material may rest on and/or against: the sidewall surfaces 239 of angled internal ribs 106; the upper surface 121 of cross/lateral internal ribs 109; interior surface 187 of first exterior elongated plate 151; and/or interior surface 190 of second exterior elongated plate 154.

The dimensions of the apertures 67 of the elongated body of the pile according to the present invention are typically selected based on a combination of factors, including but not limited to, the type of penetrable material into which the molded pile is driven, the type of fluid that is passed through the elongated tube, and the pressure under which the fluid is passed through the tube. Generally, the plurality of apertures each have a maximum linear dimension (e.g., a bisector in the case of triangular shaped apertures) that is substantially equivalent to 25 percent to 50 percent of the linear distance between the interior surfaces of the first and second exterior elongated plates. In addition, the plurality of apertures 67 each have a depth (relative to the elongated edge 65 of the first and second exterior elongated plates 151, 154) that is substantially equivalent to 25 percent to 50 percent of the width of each of the first 151 and second 154 exterior elongated plate. As such, apertures 67 extend into the first elongated open side 215, and the second elongated open side 218 of elongated body 52 relative to the elongated edges 65 of the first exterior elongated plate 151 and the second exterior elongated plate 154, and may be referred to as deep apertures 67. The presence of deep apertures 67 enhances the receipt and retention of fluidized penetrable material therein. The first 215 and second 218 elongated open sides of the elongated body will be described in further detail herein.

In an embodiment, the plurality of internal ribs 157 of the elongated body 52 of the molded pile (e.g., molded pile 17) includes an elongated transverse rib 184 that extends substantially the length of elongated body 52 (e.g., from upper end 145 to lower end 148). Elongated transverse rib 184 also extends transversely and continuously between first exterior elongated plate 151 and second exterior elongated plate 154. More particularly, elongated transverse rib 184 extends transversely and continuously between interior surface 187 of first exterior elongated plate 151 and interior surface 190 of second elongated exterior plate 154. In addition, elongated transverse rib 184 defines and contains elongated passage 160. See for example, FIG. 2.

Elongated transverse rib 184 is typically thicker than the other internal ribs of the elongated body. For example, in an embodiment, elongated transverse rib 184 has a thickness that is from 25 percent to 50 percent greater than the average thickness of the other internal ribs (e.g., internal ribs 106 and 109). In addition to defining elongated passage 160 (through which elongated tube 142 extends), elongated transverse rib 184 provides elongated body 52 with improved dimensional stability.

That portion of elongated transverse rib 184 that defines elongated passage 160 may have open or closed sidewalls 194. Typically, that portion of elongated transverse rib 184 that defines elongated passage 160 has substantially continuous and closed sidewalls 194, in which case elongated passage 160 is defined by substantially continuous and closed sidewalls (e.g., sidewalls 194).

Elongated body 52 has a longitudinal axis 197, and elongated passage 160 has a longitudinal axis 200. Longitudinal axis 197 of elongated body 52 and longitudinal axis 200 of elongated passage 160 may be parallel or non-parallel. When longitudinal axis 197 of elongated body 52 and longitudinal axis 200 of elongated passage 160 are non-parallel, elongated passage 160 typically passes at an angle through elongated body 52, and longitudinal axis 197 and longitudinal axis 200 form an offset angle relative to each other (not shown). More typically, longitudinal axis 197 of elongated body 52 and longitudinal axis 200 of elongated passage 160 are parallel with each other. In an embodiment, longitudinal axis 197 of elongated body 52 and longitudinal axis 200 of elongated passage 160 are substantially aligned, as depicted in the drawing figures.

Elongated body 52 may include a top plate 203 that serves to substantially define the upper end 145 of the elongated body. Top plate 203 has an aperture 206 therein that is aligned and in fluid communication with elongated channel 160, and which is dimensioned to receive elongated tube 142 there-through. Top plate 203 may be fabricated from metal, and separately joined (e.g., by fasteners and/or adhesives) to elongated body 52. In an embodiment of the present invention, top plate 203 is fabricated from plastic material and is continuous with first exterior elongated plate 151, second exterior elongated plate 154, and the plurality of internal ribs 157.

Figure 2:
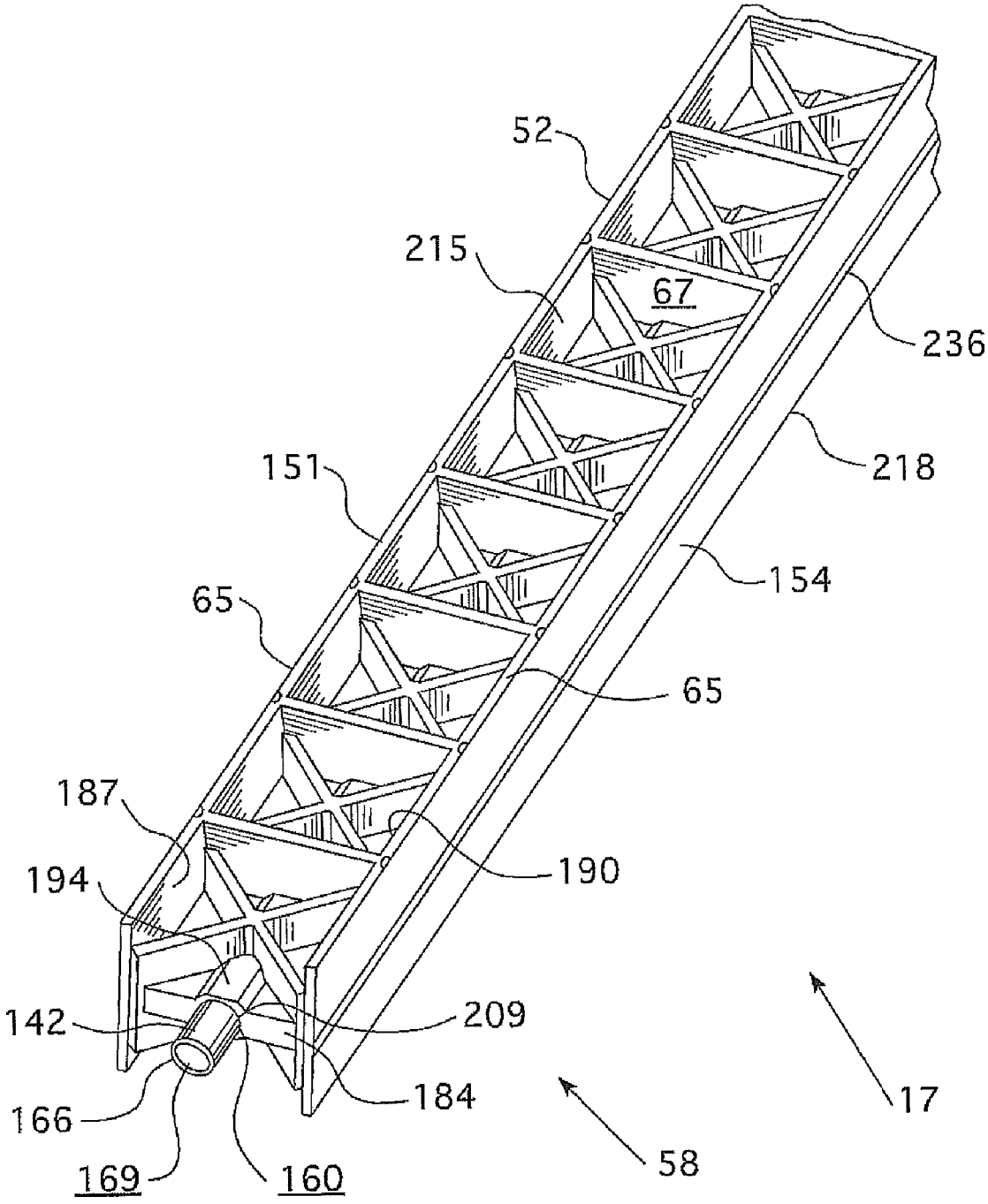
FIG. 2 is a representative perspective view of the lower portion of the molded pile of FIG. 1.

Elongated passage 160 typically has a lower terminus 209 (FIG. 2). The lower opening 166 of elongated tube 142 may be recessed back within elongated passage 160 of elongated body 52, in which case lower opening 166 resides vertically above lower terminus 209 (not shown). In an embodiment, lower opening 166 of elongated tube 142 is positioned beyond (or vertically below) lower terminus 209 of elongated passage 160 (FIG. 2). Lower opening 166 of elongated tube 142 thus extends out of or beyond elongated channel 160 of elongated body 52. Positioning lower opening 166 of elongated tube 142 beyond lower terminus 209 of elongated passage 160, and beyond lower end 148 of elongated body 52 may be undertaken for reasons, including but not limited to, enhancing fluid assisted driving of the molded pile into a penetrable material, such as soil. With the lower opening 166 of elongated tube 142 so extended (beyond lower terminus 209 of elongated passage 160, and beyond lower end 148 of elongated body 52), high pressure fluid emerging from lower tube end 166 impinges upon and begins to fluidize the penetrable material there-below before the lower end 148 of elongated body 52 contacts the penetrable material, thereby assisting entry or driving of the molded pile into the penetrable material.

Figure 3:
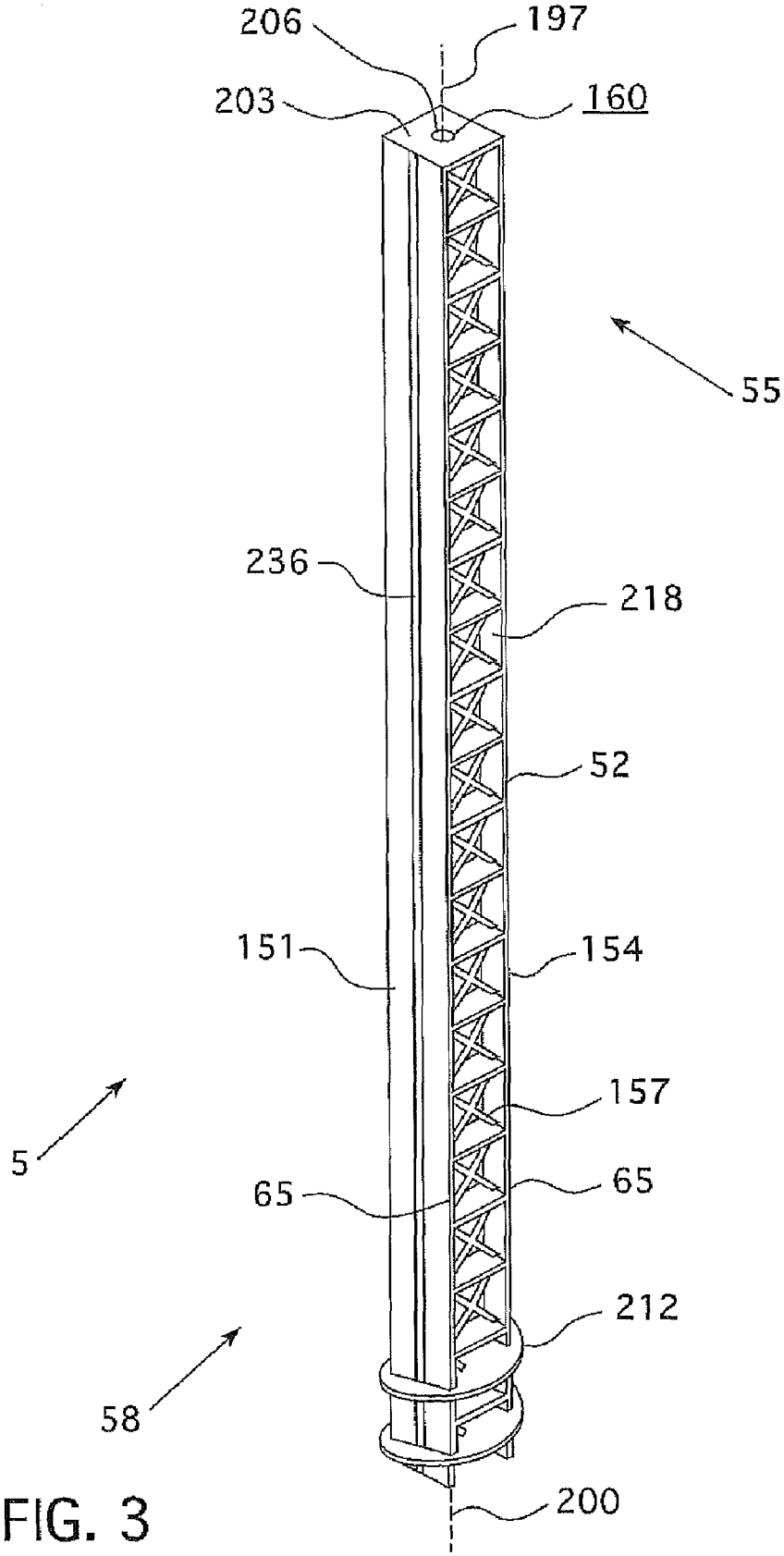
FIG. 3 is a representative perspective view of a molded pile, according to the present invention, in which the lower portion thereof includes a circumferential helical flange.

With reference to FIG. 3, the lower portion of 58 of elongated body 52 of the molded pile 5 includes a circumferential helical flange 212 that extends substantially transversely (or laterally) outward relative to the longitudinal axis 197 of elongated body 52. Circumferential helical flange 212 also extends substantially transversely (or laterally) outward beyond first exterior elongated plate 151 and second exterior elongated plate 154 of elongated body 52. Circumferential helical flange 212 is fabricated from plastic material and is substantially continuous with first exterior elongated plate 151, second exterior elongated plate 154 and the plurality of internal ribs 157, and as such circumferential helical flange 212 is part of elongated body 52.

Circumferential helical flange 212 is dimensioned, in an embodiment, so as to auger lower portion 58 into a penetrable material (e.g., soil) as elongated body 52 is rotated about its longitudinal axis 197. To assist augering lower portion 58 of elongated body 52 into a penetrable material, circumferential helical flange 212 may have a downward spiral. In addition to assisting augering lower portion 58 of elongated body 52 into a penetrable material, circumferential helical flange 212 may also assist removal of lower portion 58 from the penetrable material by rotating elongated body 52 in the opposite direction around its longitudinal axis 197.

The apertures defined by the plurality of internal ribs of the elongated body may have any suitable shape, provided they are capable of receiving and retaining fluidized penetrable material therein, as discussed previously herein. For example, the plurality of apertures 67, defined by the plurality of internal ribs 157, may have shapes selected from polygonal shapes (e.g., triangular, square, rectangular, pentagonal, hexagonal, heptagonal, octagonal, etc.), circular shapes, oval shapes, irregular shapes and combinations thereof. As depicted in the drawings, internal ribs 157 define apertures 67 having substantially polygonal shapes, and, in particular, substantially triangular shapes and substantially rectangular shapes (the triangular shaped apertures 230 being recessed within the larger rectangular shaped apertures 233—FIG. 4).

In an embodiment of the present invention, and with further reference to FIG. 4, the elongated body, and, in particular, the first and second elongated open sides (215, 218) of the elongated body 52 include recessed internal ribs 106 having sidewall surfaces 239 that (optionally together with the interior surfaces 187 and 190 of the first and second exterior elongated plates 151,154) define recessed apertures 230 (e.g., triangular recessed apertures 230). Recessed internal ribs 106 have ridges 240 that are recessed within the elongated open sides (215, 218) of the elongated body relative to the elongated edges 65 of the first 151 and second 154 exterior elongated plates.

Alternatively, or in addition to recessed internal ribs 106 that define recessed apertures 230, the elongated body, and more particularly the first and second elongated open sides (215, 218) of elongated body 52 may include non-recessed internal ribs 109 having sidewall surfaces 121 and 243 that (optionally together with the interior surfaces 187 and 190 of the first and second exterior elongated plates 151 and 154) define non-recessed apertures 233 (e.g., rectangular apertures 233). Non-recessed internal ribs 109 have ridges 246 that are substantially flush with and/or extend outward relative to (e.g., beyond) the elongated edges 65 of the first 151 and second 154 exterior elongated plates. As depicted in FIG. 4, ridges 246 of non-recessed internal ribs 109 are substantially flush with the elongated edges 65 of the first 151 and second 154 exterior elongated plates.

The elongated body 52, in an embodiment, may have (in addition to the first and second exterior elongated plates) a first elongated open side 215 and a second elongated open side 218 that are substantially opposed to each other. The first elongated open side 215 and the second elongated open side 218 are each defined by the plurality of internal ribs 157. Second elongated open side 218 is not visible in the drawings. The first elongated open side 215 and the second elongated open side 218 of elongated body 52 may be substantially symmetrical (e.g., each having the same configuration of internal ribs 157 and associated apertures 67), or unsymmetrical (e.g., each having a different configuration of internal ribs 157 and associated apertures 67). Typically, first elongated open side 215 and second elongated open side 218 of elongated body 52 are substantially symmetrical, and each have substantially the same configuration of internal ribs 157 and associated apertures 67. The first elongated open side 215 and the second elongated open side 218 may each independently be referred to as an apertured sidewall 64.

When elongated body 52 includes first elongated open side 215 and second elongated open side 218, at least one aperture 67, defined by the plurality of internal ribs 157, may provide fluid communication between the first elongated open side 215 and the second elongated open side 218, in particular in the area of the lower portion 58 of elongated body 52. For example, at least one aperture 67 may itself be a perforation, or include a perforation that provides such fluid communication between the first and second elongated open sides.

Figure 5:
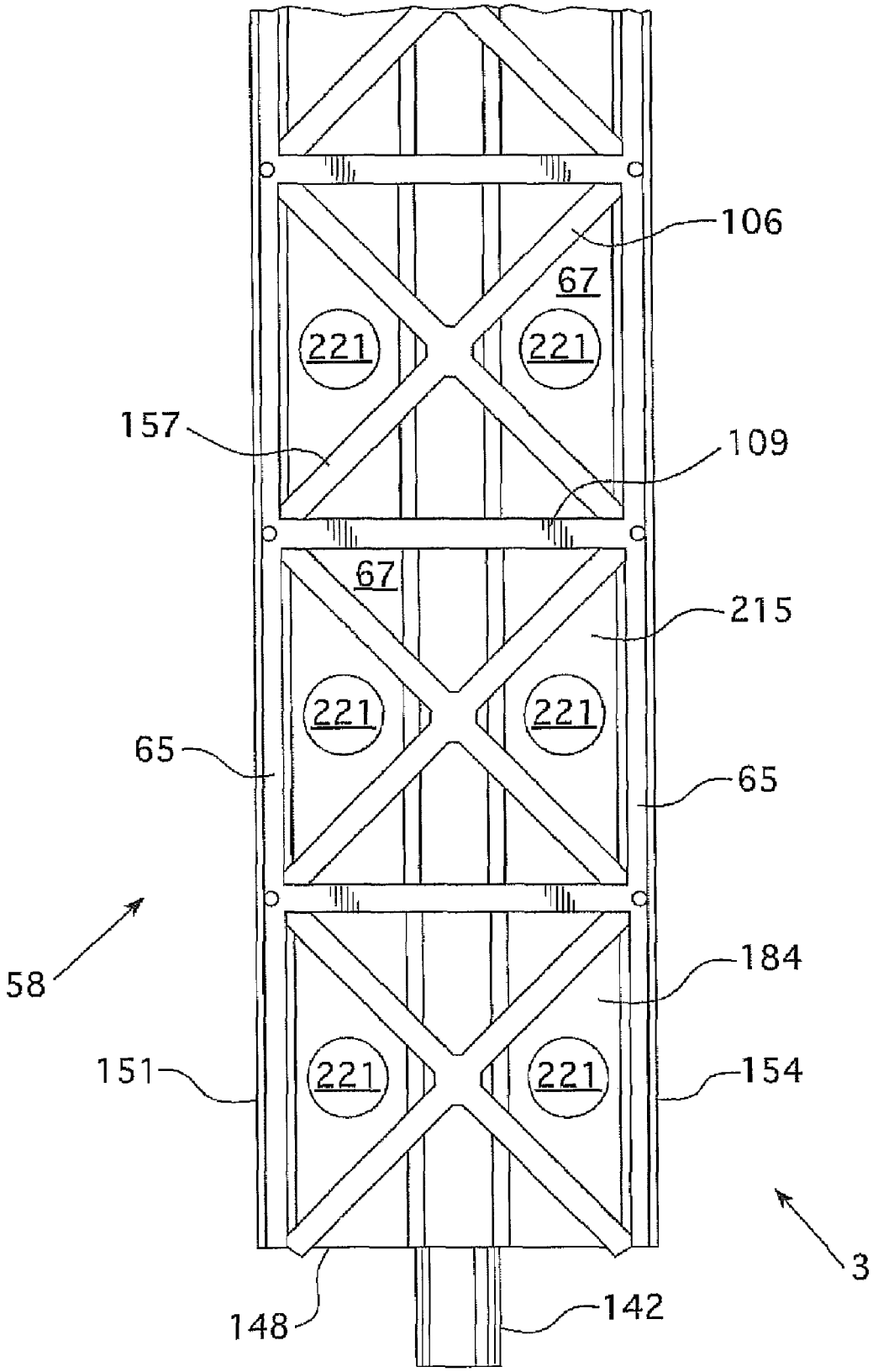
FIG. 5 is a representative elevational view of a first elongated open (or apertured) side of the lower portion of a molded pile, according to the present invention, that further includes perforations that provide fluid communication between the first and second elongated open sides thereof.

With reference to FIGS. 5 and 6, some of the internal ribs 157 of lower portion 58 of elongated body 52 define apertures 67 that further include perforations 221 that provide fluid communication between first elongated open side 215 and second elongated open side 218 (not visible). More particularly, internal ribs 157 define the perforations 221. Further particularly, elongated transverse rib 184 (which is an internal rib) defines and includes the perforations 221.

Providing the internal ribs of the lower portion of the elongated body with apertures/perforations that provide fluid communication between the first and second elongated open sides of the elongated body, further enhances anchoring of the lower portion thereof within a penetrable material, such as earth (e.g., soil and/or sand). As molded pile 3 is driven into a penetrable material (by fluid assistance), fluidized penetrable material (e.g., 181) enters apertures 67 of first elongated open side 215 and second elongated open side 218, and passes there-between through perforations 221 in elongated transverse rib 184. When the fluidized penetrable material converts to (e.g., back to) a non-fluidized state, non-fluidized penetrable material within apertures 67 extends from first elongated open side 215 to second elongated open side 218 (and visa versa) through perforations 221. The non-fluidized penetrable material within aperture 67 is also (or becomes) continuous with non-fluidized material surrounding lower portion 58 of elongated body 52. As such, a continuum of non-fluidized penetrable material exists around lower portion 58 of elongated body 52, in the apertures 67 of the first and second elongated open sides (215, 218), and between the first and second elongated open sides (215, 218) via perforations 221. Such a continuum of non-fluidized penetrable material surrounding and extending through lower portion 58 of elongated body 58 serves to better anchor lower portion 58 within the penetrable material.

The penetrable material may be selected from any material into which the molded pile may be driven and anchored. The penetrable material may be selected from, for example, grain (e.g., edible grain, such as corn, barley and/or wheat, and non-edible grain, such as grass and/or flower seed), earth (e.g., sand and/or soil), ice, snow, cementatious material (e.g., cement, such as Portland cement) and combinations thereof. When the penetrable material is earth, such as sand and/or soil, it may further include aggregate materials, such as rocks and/or cinders, provided they are not so large as to prevent the molded pile from being driven therein. In the case of cementations materials, such as cement, the molded pile may be driven down into: liquid cement; or earth followed by the introduction of liquid cement into a cavity formed around the lower portion of the elongated body. The cementatious material may be introduced through the elongated tube and/or poured into the cavity, as will be described in further detail herein.

The elongated tube of the molded pile of the present invention may have any suitable cross-sectional shape, provided high pressure fluid may be passed there-through. For example, the elongated tube may have a cross-sectional shape (i.e., as defined by the exterior surface of the sidewalls of the elongated tube) selected from polygonal shapes (e.g., triangular, square, rectangular, pentagonal, hexagonal, heptagonal, octagonal, etc.) circular shapes, oval shapes (e.g., elliptical shapes), irregular shapes and combinations thereof. The elongated hollow interior (e.g., 169) may have a cross-sectional shape that is the same or different than that of the elongated tube. The cross-sectional shape of the elongated hollow interior is defined by the interior surfaces of the sidewall of the elongated tube. The cross-sectional shape of the elongated hollow interior of the elongated tube may be selected from polygonal shapes (e.g., triangular, square, rectangular, pentagonal, hexagonal, heptagonal, octagonal, etc.) circular shapes, oval shapes (e.g., elliptical shapes), irregular shapes and combinations thereof. Typically, the elongated tube and the elongated hollow interior thereof each have substantially the same cross-sectional shape.

Elongated tube 142 may be loosely held within elongated passage 160 of elongated body 52. In an embodiment, elongated tube 142 is fixedly held within elongated passage 160 of elongated body 52. Elongated tube 142 may be fixedly held within elongated passage 160 by art-recognized means, such as adhesives, and/or clamps positioned at the upper 163 and lower 166 openings of the elongated tube.

In an embodiment, the elongated tube is fixed (i.e., caused to be fixedly held) within the elongated passage during mold formation of the elongated body. The elongated tube may, for example, be suspended within a mold cavity followed by the introduction of a fluid (e.g., molten) plastic material into the mold cavity, thereby encasing and fixing the elongated tube within the introduced plastic material, in accordance with art-recognized methods. Fixing the elongated tube within the elongated passage during mold formation of the elongated body, in effect, results in the concurrent formation of the elongated passage (by the exterior surfaces of the elongated tube) and fixing of the elongated tube within the introduced plastic material.

The various components of the molded pile of the present invention, including but not limited to, the first exterior elongated plate, the second exterior elongated plate, the plurality of internal ribs, the top cap, and the elongated tube, may each independently be fabricated from a plastic material selected from thermoset plastic materials, thermoplastic materials and combinations thereof. As used herein and in the claims, the term "thermoset plastic material" and similar terms, such as "thermosetting or thermosetable plastic materials" means plastic materials having, or that form, a three dimensional crosslinked network resulting from the formation of covalent bonds between chemically reactive groups, e.g., active hydrogen groups and free isocyanate groups, or between unsaturated groups.

Thermoset plastic materials from which the various components of the molded pile (e.g., the first exterior elongated plate, the second exterior elongated plate, the plurality of internal ribs, the top cap, and the elongated tube) may each be independently fabricated, include those known to the skilled artisan, e.g., crosslinked polyurethanes, crosslinked polyepoxides, crosslinked polyesters and crosslinked polyunsaturated polymers. The use of thermosetting plastic materials typically involves the art-recognized process of reaction injection molding. Reaction injection molding typically involves, as is known to the skilled artisan, injecting separately, and preferably simultaneously, into a mold, for example: (i) an active hydrogen functional component (e.g., a polyol and/or polyamine); and (ii) an isocyanate functional component (e.g., a diisocyanate such as toluene diisocyanate, and/or dimers and trimers of a diisocyanate such as toluene diisocyanate). The filled mold may optionally be heated to ensure and/or hasten complete reaction of the injected components.

As used herein and in the claims, the term "thermoplastic material" and similar terms, means a plastic material that has a softening or melting point, and is substantially free of a three dimensional crosslinked network resulting from the formation of covalent bonds between chemically reactive groups, e.g., active hydrogen groups and free isocyanate groups. Examples of thermoplastic materials from which the components of the molded pile (e.g., the first exterior elongated plate, the second exterior elongated plate, the plurality of internal ribs, the top cap, and the elongated tube) may be independently fabricated include, but are not limited to, thermoplastic polyurethane, thermoplastic polyurea, thermoplastic polyimide, thermoplastic polyamide, thermoplastic polyamideimide, thermoplastic polyester, thermoplastic polycarbonate, thermoplastic polysulfone, thermoplastic polyketone, thermoplastic polyolefins, thermoplastic(meth) acrylates, thermoplastic acrylonitrile-butadiene-styrene, thermoplastic styrene-acrylonitrile, thermoplastic acrylonitrile-stryrene-acrylate and combinations thereof (e.g., blends and/or alloys of at least two thereof).

In an embodiment of the present invention, the thermoplastic material from which the components of the molded pile (e.g., the first exterior elongated plate, the second exterior elongated plate, the plurality of internal ribs, the top cap, and the elongated tube) may be fabricated, is in each case independently selected from thermoplastic polyolefins. As used herein and in the claims, the term "polyolefin" and similar terms, such as "polyalkylene" and "thermoplastic polyolefin", means polyolefin homopolymers, polyolefin copolymers, homogeneous polyolefins and/or heterogeneous polyolefins. For purposes of illustration, examples of a polyolefin copolymers include those prepared from ethylene and one or more $C_3$-$C_{12}$ alpha-olefins, such as 1-butene, 1-hexene and/or 1-octene.

The polyolefins, from which the thermoplastic material of the various components of the molded pile, may in each case be independently selected, include heterogeneous polyolefins, homogeneous polyolefins, or combinations thereof. The term "heterogeneous polyolefin" and similar terms means polyolefins having a relatively wide variation in: (i) molecular weight amongst individual polymer chains (i.e., a polydispersity index of greater than or equal to 3); and (ii) monomer residue distribution (in the case of copolymers) amongst individual polymer chains. The term "polydispersity index" (PDI) means the ratio of $M_w/M_n$, where $M_w$ means weight average molecular weight, and $M_n$ means number average molecular weight, each being determined by means of gel permeation chromatography (GPC) using appropriate standards, such as polyethylene standards. Heterogeneous polyolefins are typically prepared by means of Ziegler-Natta type catalysis in heterogeneous phase.

The term "homogeneous polyolefin" and similar terms means polyolefins having a relatively narrow variation in: (i) molecular weight amongst individual polymer chains (i.e., a polydispersity index of less than 3); and (ii) monomer residue distribution (in the case of copolymers) amongst individual polymer chains. As such, in contrast to heterogeneous polyolefins, homogeneous polyolefins have similar chain lengths amongst individual polymer chains, a relatively even distribution of monomer residues along polymer chain backbones, and a relatively similar distribution of monomer residues amongst individual polymer chain backbones. Homogeneous polyolefins are typically prepared by means of single-site, metallocene or constrained-geometry catalysis. The monomer residue distribution of homogeneous polyolefin copolymers may be characterized by composition distribution breadth index (CDBI) values, which are defined as the weight percent of polymer molecules having a comonomer residue content within 50 percent of the median total molar comonomer content. As such, a polyolefin homopolymer has a CDBI value of 100 percent. For example, homogenous polyethylene/alpha-olefin copolymers typically have CDBI values of greater than 60 percent or greater than 70 percent. Composition distribution breadth index values may be determined by art recognized methods, for example, temperature rising elution fractionation (TREF), as described by Wild et al, Journal of Polymer Science, Poly. Phys. Ed., Vol. 20, p. 441 (1982), or in U.S. Pat. No. 4,798,081, or in U.S. Pat. No. 5,089,321. An example of homogeneous ethylene/alpha-olefin copolymers are SURPASS polyethylenes, commercially available from NOVA Chemicals Inc.

The plastic material from which the various components of the molded pile (e.g., the first exterior elongated plate, the second exterior elongated plate, the plurality of internal ribs, the top cap, and the elongated tube) may be fabricated, may in each case independently and optionally include a reinforcing material selected, for example, from glass fibers, glass beads, carbon fibers, metal flakes, metal fibers, polyamide fibers (e.g., KEVLAR polyamide fibers), cellulosic fibers, nanoparticulate clays, talc and mixtures thereof. If present, the reinforcing material is typically present in a reinforcing amount, e.g., in an amount of from 5 percent by weight to 60 or 70 percent by weight, based on the total weight of the component. The reinforcing fibers, and the glass fibers, in particular, may have sizings on their surfaces to improve miscibility and/or adhesion to the plastic materials into which they are incorporated, as is known to the skilled artisan.

In an embodiment of the invention, the reinforcing material is in the form of fibers (e.g., glass fibers, carbon fibers, metal fibers, polyamide fibers, cellulosic fibers and combinations of two or more thereof). The fibers typically have lengths (e.g., average lengths) of from 0.5 inches to 4 inches (1.27 cm to 10.16 cm). The various components of the molded pile of the present invention may each independently include fibers having lengths that are at least 50 or 85 percent of the lengths of the fibers that are present in the feed materials from which the each individual component is prepared, such as from 0.25 inches to 2 or 4 inches (0.64 cm to 5.08 or 10.16 cm). The average length of fibers present in components of the molded pile may be determined in accordance with art recognized methods. For example, the molded pile (or components thereof) may be pyrolyzed to remove the plastic material, and the remaining or residual fibers microscopically analyzed to determine their average lengths, as is known to the skilled artisan.

Fibers are typically present in the plastic materials of the various components of the molded pile (e.g., the first exterior elongated plate, the second exterior elongated plate, the plurality of internal ribs, the top cap, and the elongated tube) in amounts independently from 5 to 70 percent by weight, 10 to 60 percent by weight, or 30 to 50 percent by weight (e.g., 40 percent by weight), based on the total weight of the component (e.g., the weight of the plastic material, the fiber and any additives). Accordingly, the various components of the molded pile may each independently include fibers in amounts of from 5 to 70 percent by weight, 10 to 60 percent by weight, or 30 to 50 percent by weight (e.g., 40 percent by weight), based on the total weight of the particular component (or combinations of portions thereof that include reinforcing fibers).

The fibers may have a wide range of diameters. Typically, the fibers have diameters of from 1 to 20 micrometers, or more typically from 1 to 9 micrometers. Generally, each fiber comprises a bundle of individual filaments (or monofilaments). Typically, each fiber is composed of a bundle of 10,000 to 20,000 individual filaments.

Typically, the fibers are uniformly distributed throughout the plastic material. During mixing of the fibers and the plastic material, the fibers generally form bundles of fibers typically comprising at least 5 fibers per fiber bundle, and preferably less than 10 fibers per fiber bundle. While not intending to be bound by theory, it is believed, based on the evidence at hand, that fiber bundles containing 10 or more fibers may result in a molded article, such as a molded pile, having undesirably reduced structural integrity. The level of fiber bundles containing 10 or more fibers per bundle, may be quantified by determining the Degree of Combing present within a molded article. The number of fiber bundles containing 10 or more fibers per bundle is typically determined by microscopic evaluation of a cross section of the molded article, relative to the total number of microscopically observable fibers (which is typically at least 1000). The Degree of Combing is calculated using the following equation: 100× ((number of bundles containing 10 or more fibers)/(total number of observed fibers)). Generally, the molded pile (or portions thereof, e.g., the elongated body) has/have a Degree of Combing of less than or equal to 60 percent, and typically less than or equal to 35 percent.

In addition or alternatively to reinforcing material(s), the plastic materials of the various components of the molded pile (e.g., the first exterior elongated plate, the second exterior elongated plate, the plurality of internal ribs, the top cap, and the elongated tube) may in each case independently and optionally include one or more additives. Additives that may be present in the plastic materials of the various components of the molded pile of the present invention include, but are not limited to, antioxidants, colorants, e.g., pigments and/or dyes, mold release agents, fillers, e.g., calcium carbonate, ultraviolet light absorbers, fire retardants and mixtures thereof. Additives may be present in the plastic material of each component of the molded pile in functionally sufficient amounts, e.g., in amounts independently from 0.1 percent by weight to 10 percent by weight, based on the total weight of the particular component.

The plastic components of the molded pile of the present invention may be prepared by art-recognized methods, including, but not limited to, injection molding, reaction injection molding, compression molding and combinations thereof. The plastic components of the molded pile (and, in particular, the elongated body thereof) may be fabricated by a compression molding process that includes: providing a compression mold comprising a lower mold portion and an upper mold portion; forming (e.g., in an extruder) a molten composition comprising plastic material and optionally reinforcing material, such as fibers; introducing, by action of gravity, the molten composition into the lower mold portion; compressively contacting the molten composition introduced into the lower mold portion with the interior surface of the upper mold portion; and removing the molded component (e.g., the elongated body) from the mold. The lower mold portion may be supported on a trolley that is reversibly moveable between: (i) a first station where the molten composition is introduced therein; and (ii) a second station where the upper mold portion is compressively contacted with the molten composition introduced into the lower mold portion.

If the two or more components of the elongated body (e.g., the first and second elongated exterior plates, and/or the internal ribs) of the molded pile are fabricated from different plastic materials (or compositions), different plastic materials/compositions may be concurrently and/or sequentially introduced into different portions of the mold, in which the various components are formed. Generally, the various components of the elongated body (e.g., the first and second elongated exterior plates, the internal ribs, and optionally the top cap) are all fabricated from the same plastic material, and as such a single plastic composition is introduced into the mold.

The lower mold portion may be moved concurrently in time and space (e.g., in x-, y- and/or z-directions, relative to a plane in which the lower mold resides) as the molten composition is gravitationally introduced therein. Such dynamic movement of the lower mold portion provides a means of controlling, for example, the distribution, pattern and/or thickness of the molten composition that is gravitationally introduced into the lower mold portion. Alternatively, or in addition to movement of the lower mold portion in time and space, the rate at which the molten composition is introduced into the lower mold portion may also be controlled. When the molten composition is formed in an extruder, the extruder may be fitted with a terminal dynamic die having one or more reversibly positionable gates through which the molten composition flows before dropping into the lower mold portion. The rate at which the molten composition is gravitationally deposited into the lower mold portion may be controlled by adjusting the gates of the dynamic die.

The compressive force applied to the molten plastic composition introduced into the lower mold portion is typically from 25 psi to 550 psi (1.8 to 38.7 Kg/cm$^2$), more typically from 50 psi to 400 psi (3.5 to 28.1 Kg/cm$^2$), and further typically from 100 psi to 300 psi (7.0 to 21.1 Kg/cm$^2$). The compressive force applied to the molten plastic material may be constant or non-constant. For example, the compressive force applied to the molten plastic material may initially be ramped up at a controlled rate to a predetermined level, followed by a hold for a given amount of time, then followed by a ramp down to ambient pressure at a controlled rate. In addition, one or more plateaus or holds may be incorporated into the ramp up and/or ramp down during compression of the molten plastic material. The plastic components of the molded pile of the present invention may, for example, be prepared in accordance with the methods and apparatuses described in U.S. Pat. Nos. 6,719,551; 6,869,558; 6,900,547; and 7,208,219.

In an embodiment of the present invention, the components of the molded pile (e.g., the first exterior elongated plate, the second exterior elongated plate, the plurality of internal ribs, the top cap, and the elongated tube) are each independently a molded article formed from a molten composition comprising fibers (e.g., glass fibers, carbon fibers, metal fibers, polyamide fibers and/or cellulosic fibers). As used with regard to this particular embodiment of the invention herein and in the claims, the term "molded article" means at least one of the plastic components of the molded pile, such as the first exterior elongated plate, the second exterior elongated plate, the plurality of internal ribs, the top cap, and/or the elongated tube. The molten composition is formed from plastic material and feed fibers. The molten composition may be formed by introducing the plastic material and feed fibers sequentially or concurrently into, and optionally at multiple points along the length of, an extruder. The feed fibers have a length of 1.27 cm to 10.16 cm (0.5 inches to 4 inches). The fibers are present in the molded article (e.g., the first and second exterior elongated plates) in an amount of from 5 percent by weight to 70 percent by weight, based on the total weight of the particular molded article. The fibers of the molded article (e.g., the first and second exterior elongated plates) have lengths (e.g., average lengths) that are at least 60% of the lengths (e.g., average lengths) of the feed fibers, and as such have lengths of, for example: from 0.762 cm (0.3 inches) to 10.16 cm (4 inches); or from 0.762 cm (0.3 inches) to 6.096 cm (2.4 inches). In addition, less than 20 percent of the fibers of the molded article are oriented in the same direction, relative to any of the x-, y- and z-axis (or any combination thereof of the molded article.

The elongated tube of the molded pile may be fabricated from a material selected from the group consisting of thermoset materials, thermoplastic materials, metals and combinations thereof. The thermoset and thermoplastic materials from which the elongated tube may be fabricated, include those recited and discussed previously herein (optionally including fibers and/or additives as described previously herein).

In an embodiment, the elongated tube of the molded pile is fabricated from at least one metal. The metal from which the elongated tube is fabricated may be selected from, for example, iron, steel, nickel, aluminum, copper, titanium and combinations thereof.

The molded pile of the present invention may have any suitable dimensions. For example, the molded pile may have a length (e.g., from upper end 145 to lower end 148 of elongated body 52) of from 122 cm to 914 cm (4 feet to 30 feet), or 152 cm to 726 cm (5 feet to 25 feet), or 182 cm to 609 cm (6 feet to 20 feet). In an embodiment, the molded pile has a length (e.g., from upper end 145 to lower end 148 of elongated body 52) of approximately 244 cm (8 feet). When elongated body 52 has a substantially rectangular cross-section, each side of the rectangular cross-section thereof may have length of from 5.1 cm to 30.5 cm (2 inches to 12 inches), or 10.2 cm to 25.4 cm (4 inches to 10 inches), or 12.7 cm to 20.3 cm (5 inches to 8 inches). In an embodiment, elongated body 52 has a substantially rectangular cross-section, and each side of the rectangular cross-section thereof has a length of approximately 15.2 cm (6 inches), in which case, the molded pile may be referred to as a 15.2 cm by 15.2 cm (6 inch by 6 inch) molded pile.

The present invention also relates to a method of installing a pile. With reference to FIG. 6, the method includes providing a molded pile (e.g., 17, 3 or 5) as described previously herein, and positioning the lower end 148 of elongated body 52 thereof adjacent to the surface 224 of a penetrable material 178 (e.g., earth, such as soil and/or sand). As described previously, the penetrable material may be selected from, for example, grain, earth (e.g., sand and/or soil), ice, snow, cementatious material (e.g., cement, such as Portland cement) and combinations thereof.

A fluid (e.g., water and/or air) is introduced at elevated pressure into upper opening 163 of elongated tube 142 (e.g., as represented by arrow 172). The term "elevated pressure" means a pressure greater than ambient atmospheric pressure. The high pressure fluid may be introduced into upper opening 163 by means of a conduit, such as a hose (not shown), that is attached to upper opening 163, for example by means of a coupling, such as a quick connect/disconnect coupling (not shown), as is known to the skilled artisan. After introduction into upper opening 163, the fluid is allowed to pass through elongated hollow interior 169 of elongated tube 142 at elevated pressure, and exit lower opening 166 at elevated pressure (e.g., as represented by arrows 175).

Lower end 166 of elongated tube 142 may be fitted with a nozzle (not shown) having one or more openings that vectorly direct the high pressure fluid emerging therefrom. The nozzle may have openings that direct the high pressure fluid downward, laterally outward, upward (typically at an angle) and combinations thereof. Providing a portion of the high pressure fluid emerging from lower end 166 of elongated tube 142 with an upward vector may serve to assist removal of fluidized penetrable material from around lower portion 58 of elongated body 52, which may be desirable if the fluidized penetrable material is to be replaced with another material, such as cementations material.

Concurrently with the step of passing high pressure fluid through elongated tube 142 and out of lower end 166 thereof, lower portion 58 of elongated body 52 is driven into the penetrable material 178. A downward force is typically exerted on the molded pile as it is driven into the penetrable material. The downward force may be exerted manually (e.g., by hand) and/or mechanically (e.g., by means of mechanical pile driver), as is known to the skilled artisan. The driving step may optionally be performed reciprocally, in which case the lower portion of the elongated body is driven down into the penetrable material, drawn at least partially back out, and then driven down in again. Performing the driving step in such a reciprocal fashion may serve to enhance removal of fluidized penetrable material from around the lower portion of the elongated body.

As the molded pile is driven down into the penetrable material, high pressure fluid exiting lower opening 166 of elongated tube 142 impinges upon the penetrable material, thereby resulting in the formation of fluidized penetrable material. The fluidized penetrable material is typically composed of particulate penetrable material and the fluid impinged there-with. In the case of ice and/or snow, the fluidized penetrable material may be composed of, for example, liquid alone, liquid and gas, or liquid and at least one of gas or particulate ice.

As lower portion 58 of elongated body 52 is driven down into the penetrable material, the apertures 67 of the lower portion receive fluidized penetrable material therein. The fluidized penetrable material, as described previously herein, returns or is converted to a non-fluidized state within the apertures, and becomes continuous with non-fluidized penetrable material surrounding the lower portion of the elongated body, thereby anchoring the lower portion within the penetrable material.

The fluid that is introduced into the elongated tube, at elevated pressure, in the method of the present invention, may be selected from gasses, liquids, and combinations thereof. The fluid may be introduced at ambient temperature, sub-ambient temperature, or super-ambient temperature. In the case of the penetrable material being ice and/or snow, the fluid may advantageously be introduced at supra-ambient temperature (e.g., at a temperature greater than the freezing point of water). When in the form of a gas, the fluid may be selected from known gasses, such as air and nitrogen. When in the form of a liquid, the fluid may be selected from suitable liquids, such as, water, organic solvents (e.g., alcohols, such as methanol and/or ethanol, hydrocarbons and/or ketones) and combinations thereof. In an embodiment, the fluid is selected from air, water and combinations thereof.

In an embodiment of the method of the present invention, the fluid that is introduced and passed through the elongated tube may optionally include an abrasive particulate material. The presence of the abrasive particulate material may enhance removal and/or fluidization of the penetrable material into which the lower portion of the molded pile is driven. The abrasive particulate material may be in the form of individual particles, aggregates of individual particles, or a combination of individual particles and aggregates. The shape of the abrasive particulate material may be selected from, for example, spheres, rods, triangles, pyramids, cones, regular cubes, irregular cubes, and mixtures and/or combinations thereof. The average particle size of the abrasive particulate material may vary widely, for example, from 0.001 to 200 microns, from 0.01 to 150 microns, or from 0.1 to 100 microns. The average particle size of the abrasive particulate material is typically measured along the longest dimension of the particle.

Examples of abrasive particulate materials that may be included in the fluid include, but are not limited to, aluminum oxide, e.g., gamma alumina, fused aluminum oxide, heat treated aluminum oxide, white fused aluminum oxide, and sol gel derived alumina; silicon carbide, e.g., green silicon carbide and black silicon carbide; titanium diboride; boron carbide; silicon nitride; tungsten carbide; titanium carbide; diamond; boron nitride, e.g., cubic boron nitride and hexagonal boron nitride; garnet; fused alumina zirconia; silica, e.g., fumed silica; iron oxide; cromia; ceria; zirconia; titania; tin oxide; manganese oxide; and mixtures thereof. Preferred abrasive particulate materials include, for example, aluminum oxide, silica, silicon carbide, zirconia and mixtures thereof. The amount of abrasive particulate material present in the fluid may vary widely, e.g., from 1 percent to 60 percent by weight, based on the total weight of the fluid and the abrasive material.

The abrasive particulate materials may optionally have a surface modifier thereon, to enhance and maintain dispersion or suspension of the abrasive particulate materials in the fluid (in particular when the fluid is a liquid, e.g., an aqueous liquid, such as water). Generally, the surface modifier is selected from surfactants. Classes of surfactants that may be used as surface modifiers for the abrasive particulate materials include those known to the skilled artisan, e.g., anionic, cationic, amphoteric and nonionic surfactants. More specific examples of surfactants that may be used include, but are not limited to, metal alkoxides, polyalkylene oxides, and salts of long chain fatty carboxylic acids. The surface modifier, if used, is typically present in an amount of less than 25 percent by weight, based on the total weight of the abrasive particulate material and surface modifier. More typically, the surface modifier is present in an amount of from 0.5 to 10 percent by weight, based on the total weight of the abrasive particulate material and surface modifier.

In an embodiment of the method of the present invention, the lower portion of the elongated body of the molded pile includes a circumferential helical flange 212 that extends substantially transversely outward relative to the longitudinal axis 197 of elongated body 52, as described previously herein with regard to molded pile 5 of FIG. 3. The method further includes augering, (concurrently with the step of driving lower portion 52 into the penetrable material) lower portion 58 of elongated body 52 into the penetrable material by rotating elongated body 52 about its longitudinal axis 197.

In a further embodiment of the method of the present invention, after lower portion 58 of elongated body 52 has been driven into the penetrable material, an additional amount of fluid at elevated pressure is introduced into upper opening 163 of elongated tube 142 and allowed to pass through (i.e., passes through) elongated hollow interior 169 and to exit lower opening 166 of the tube at elevated pressure. The additional amount of introduced fluid is allowed to displace (i.e., displaces) at least some of the penetrable material received within apertures 67.

Next, a fluid cementatious material (e.g., liquid Portland cement) is introduced, at elevated pressure, into upper opening 163 of elongated tube 142, allowed to pass through (i.e., passes through) elongated hollow interior 169 and to exit lower opening 166 of the tube at elevated pressure. At least some of the fluid cementations material, so introduced, is allowed to be received within (i.e., is received within) at least some of apertures 67 of lower portion 58, and to solidify, thereby further anchoring lower portion 58 of elongated body 52 within the penetrable material. More particularly, lower portion 58 of elongated tube 52 may be anchored substantially within the cementatious material, which itself is anchored within the penetrable material.

With further reference to FIG. 6, the initial and subsequent passage of high pressure fluid through elongated tube 142 results in the formation of a cavity 227 around lower portion 58 of elongated body 52. The subsequent passage of fluid cementatious material through elongated tube 142, out of lower opening 166 thereof, results in the introduction of fluid cementatious material into cavity 227. The fluid cementatious material, so introduced into cavity 227, which is also received within apertures 67 of lower portion 58 of elongated body 52, is allowed to cure and harden, thus anchoring lower portion 58 at least partially in the cured cement. In addition to passing fluid cementations material through elongated tube 142, fluid cementatious material may also be introduced directly into cavity 227 (e.g., by pouring it therein).

The molded pile of the present invention may be used in numerous applications that require a securely anchored pile. For example, the molded pile may provide support for a support panel (e.g., a support deck) by means of brackets (not shown), in which case, the molded pile and support panel together form a support structure, such as a deck or marine dock. The molded pile may be driven into penetrable material that is located beneath water, for example a river bed, lake bed or sea bed.

The present invention has been described with reference to specific details of particular embodiments thereof. It is not intended that such details be regarded as limitations upon the scope of the invention except insofar as and to the extent that they are included in the accompanying claims.

What is claimed is:

1. A molded pile comprising:

(a) an elongated body having an upper end and a lower end, and comprising, (i) a first exterior elongated plate, (ii) a second exterior elongated plate, said first exterior elongated plate and second exterior elongated plate being spaced apart and being substantially opposed from each other, and (iii) a plurality of internal ribs interposed between said first exterior elongated plate and said second exterior elongated plate, said plurality of internal ribs defining at least one elongated passage, and said plurality of internal ribs together defining a plurality of apertures, wherein said first exterior elongated plate, said second exterior elongated exterior plate and said plurality of internal ribs are each independently fabricated from a plastic material and are substantially continuous with each other, and said elongated body is a substantially unitary elongated body; and (b) an elongated tube residing within said elongated passage, said elongated tube having an upper opening and a lower opening each being in fluid communication with an elongated hollow interior of said elongated tube, said elongated tube providing fluid communication between said upper end and said lower end of said elongated body, and being adapted to provide for passage of a fluid at elevated pressure through said elongated hollow interior thereof, wherein passage of said fluid at elevated pressure through said elongated hollow interior of said elongated tube fluidizes a penetrable material into which a lower portion of said elongated body of said molded pile is driven, thereby forming a fluidized penetrable material, and said apertures of said lower portion defined by said plurality of internal ribs being dimensioned to receive fluidized penetrable material therein, thereby anchoring said lower portion of said elongated body within said penetrable material.

2. The molded pile of claim 1 wherein said elongated body has a length, and said plurality of internal ribs comprises an elongated transverse rib that extends substantially the length of said elongated body and transversely and continuously between said first exterior elongated plate and said second exterior elongated plate, said elongated transverse rib defining said elongated passage.

3. The molded pile of claim 1 wherein said elongated body has a longitudinal axis, said elongated passage has a longitudinal axis, and said longitudinal axis of said elongated body and said longitudinal axis of said elongated passage being substantially parallel with each other.

4. The molded pile of claim 3 wherein said longitudinal axis of said elongated body and said longitudinal axis of said elongated passage are substantially aligned.

5. The molded pile of claim 1 wherein said elongated body further comprises a top plate defining said upper end of said elongated body, said top plate having an aperture therein, said aperture being dimensioned to receive said elongated tube there-through, said top plate being fabricated from plastic material and being continuous with said first exterior elongated plate, said second exterior elongated plate and said plurality of internal ribs.

6. The molded pile of claim 1 wherein said elongated passage has a lower terminus, and said lower opening of said elongated tube being positioned beyond said lower terminus of said elongated passage.

7. The molded pile of claim 1 wherein said elongated body has a longitudinal axis, said lower portion of said elongated body further comprises a circumferential helical flange that extends substantially transversely outward relative to said longitudinal axis of said elongated body, said circumferential helical flange being fabricated from plastic material and being continuous with said first exterior elongated plate, said second exterior elongated plate and said plurality of internal ribs.

8. The molded pile of claim 7 wherein said circumferential helical flange is dimensioned to auger said lower portion of said elongated body into said penetrable material as said elongated body is rotated about said longitudinal axis of said elongated body.

9. The molded pile of claim 1 wherein said apertures defined by said plurality of internal ribs have shapes selected from the group consisting of polygonal shapes, circular shapes, oval shapes, irregular shapes and combinations thereof.

10. The molded pile of claim 1 wherein said plurality of internal ribs comprises recessed internal ribs, said recessed internal ribs together defining recessed apertures.

11. The molded pile of claim 10 wherein said plurality of internal ribs further comprise non-recessed internal ribs, said non-recessed internal ribs together defining non-recessed apertures.

12. The molded pile of claim 1 wherein said elongated body has a first elongated open side and a second elongated open side, said first elongated open side and said second elongated open side being substantially opposed to each other and each being defined by said plurality of internal ribs.

13. The molded pile of claim 12 wherein at least one aperture defined by said plurality of internal ribs provides fluid communication between said first elongated open side and said second elongated open side of said lower portion of said elongated body.

14. The molded pile of claim 1 wherein said penetrable material is selected from the group consisting of grain, sand, soil, snow, ice, cementatious material and combinations thereof.

15. The molded pile of claim 1 wherein said elongated tube has a cross-sectional shape selected from the group consisting of polygonal shapes, circular shapes, oval shapes, irregular shapes and combinations thereof, and said elongated hollow interior of said elongated tube has a cross-sectional shape selected from the group consisting of polygonal shapes, circular shapes, oval shapes, irregular shapes and combinations thereof.

16. The molded pile of claim 1 wherein said elongated tube is fixedly held within said elongated passage.

17. The molded pile of claim 16 wherein said elongated tube is fixed within said elongated passage during mold formation of said elongated body.

18. The molded pile of claim 1 wherein said plastic material, from which said first exterior elongated plate, said second exterior elongated plate and said plurality of internal ribs are each independently fabricated, is in each case independently selected from the group consisting of thermoset plastic material, thermoplastic material and combinations thereof.

19. The molded pile of claim 18 wherein said first exterior elongated plate, said second exterior elongated plate and said plurality of internal ribs are each independently fabricated from thermoplastic material selected independently from the group consisting of thermoplastic polyurethane, thermoplastic polyurea, thermoplastic polyimide, thermoplastic polyamide, thermoplastic polyamideimide, thermoplastic polyester, thermoplastic polycarbonate, thermoplastic polysulfone, thermoplastic polyketone, thermoplastic polyolefins, thermoplastic (meth)acrylates, thermoplastic acrylonitrile-butadiene-styrene, thermoplastic styrene-acrylonitrile, thermoplastic acrylonitrile-stryrene-acrylate and combinations thereof.

20. The molded pile of claim 18 wherein the plastic material of at least one of said first exterior elongated plate, said second exterior elongated plate and said plurality of internal ribs is reinforced with a reinforcing material selected independently from the group consisting of glass fibers, glass beads, carbon fibers, metal flakes, metal fibers, polyamide fibers, cellulosic fibers, nanoparticulate clays, talc and mixtures thereof.

21. The molded pile of claim 18 wherein said first exterior elongated plate, said second exterior elongated plate and said plurality of internal ribs are each independently a molded article formed from a molten composition comprising fibers, said molten composition being formed from plastic material and feed fibers having a length of 1.27 cm to 10.16 cm, the fibers being present in said molded article in an amount of from 5 percent by weight to 70 percent by weight, based on the total weight of said molded article, the fibers of said molded article have lengths that are at least 60% of the lengths of said feed fibers, and less than 20% of the fibers of said molded article are oriented in the same direction.

22. A method of installing a pile comprising:

(A) providing a molded pile comprising, (a) an elongated body having an upper end and a lower end, and comprising, (i) a first exterior elongated plate, (ii) a second exterior elongated plate, said first exterior elongated plate and second exterior elongated plate being spaced apart and being substantially opposed from each other, and (iii) a plurality of internal ribs interposed between said first elongated plate and said second elongated plate, said plurality of internal ribs defining at least one elongated passage, and said plurality of internal ribs together defining a plurality of apertures, wherein said first exterior elongated plate, said second elongated exterior plate and said plurality of internal ribs are each independently fabricated from a plastic material and are substantially continuous with each other, and said elongated body is a substantially unitary elongated body; and (b) an elongated tube residing within said elongated passage, said elongated tube having an upper opening and a lower opening each being in fluid communication with an elongated hollow interior of said elongated tube, said elongated tube providing fluid communication between said upper end and said lower end of said elongated body, and being adapted to provide for passage of a fluid at elevated pressure through said elongated hollow interior thereof;

(B) positioning said lower end of said elongated body adjacent to a surface of a penetrable material;

(C) introducing said fluid at elevated pressure into said upper opening of said elongated tube, and allowing said fluid to pass through said elongated hollow interior and exit said lower opening of said elongated tube at elevated pressure; and (D) driving, concurrently with step (C), a lower portion of said elongated body of said molded pile into said penetrable material, wherein said fluid exiting said lower opening of said elongated tube impinges upon said penetrable material, thereby forming fluidized penetrable material, further wherein said apertures of said lower portion of said elongated body of said molded pile are dimensioned to receive fluidized penetrable material therein, thereby anchoring said lower portion of said elongated body within said penetrable material.

23. The method of claim 22 wherein said fluid is selected from the group consisting of gas, liquid and combinations thereof.

24. The method of claim 22 wherein said elongated body has a longitudinal axis, said lower portion of said elongated body further comprises a circumferential helical flange that extends substantially transversely outward relative to said longitudinal axis of said elongated body, said circumferential helical flange being fabricated from plastic material and being continuous with said first exterior elongated plate, said second exterior elongated plate and said plurality of internal ribs, said method further comprising augering, concurrently with step (D), said lower portion of said elongated body into said penetrable material by rotating said elongated body about said longitudinal axis of said elongated body.

25. The method of claim 22 further comprising, introducing, after said lower portion of said elongated body has been driven into said penetrable material, an additional amount of fluid at elevated pressure into said upper opening of said elongated tube, and allowing said additional amount of fluid to pass through said elongated hollow interior and exit said lower opening of said elongated tube at elevated pressure, allowing said additional amount of fluid to displace at least some of the penetrable material received within said apertures, and introducing a fluid cementatious material at elevated pressure into said upper opening of said elongated tube, and allowing said fluid cementatious material to pass through said elongated hollow interior and exit said lower opening of said elongated tube at elevated pressure, and allowing at least some of said fluid cementations material to be received within at least some of said apertures of said lower portion of said elongated body, thereby further anchoring said lower portion of said elongated body within said penetrable material.

* * * * *